United States Patent [19]

Zilio

[11] Patent Number: 4,896,773

[45] Date of Patent: Jan. 30, 1990

[54] PLASTIC BOX CONTAINING BAGS MADE OF POLYETHYLENE FOR HYGIENIC USE GROUPED TOGETHER WITH A DOUBLE FOLD

[76] Inventor: Tiziano Zilio, Via Stefano Carli, 3/B, 36027 Rosa (Vicenza), Italy

[21] Appl. No.: 264,157

[22] Filed: Oct. 28, 1988

[51] Int. Cl.[4] ..... B65D 73/00

[52] U.S. Cl. ..... 206/494; 206/440

[58] Field of Search ..... 206/494, 440, 441, 438

[56] References Cited

U.S. PATENT DOCUMENTS

| | | | |
|---|---|---|---|
| 2,854,134 | 9/1958 | Humphrey | 206/494 |
| 3,383,012 | 5/1968 | Adell | 206/494 |
| 4,235,333 | 11/1980 | Boone | 206/494 |
| 4,790,436 | 12/1988 | Nakamura | 206/494 |

*Primary Examiner*—Joseph Man-Fu Moy
*Attorney, Agent, or Firm*—Bucknam and Archer

[57] ABSTRACT

The plastic box comprises bottom 1 in the shape of a rectangular basin to be fixed onto a wall, cover 2 having rounded borders and central opening 9, the cover being snap applied onto the bottom. An assembly of bags made of cardboard 3 is inserted in the interior of the bottom. The assembly is easily replaced with a new assembly. The assembly contains a plurality of bags for hygienic use made of polyethylene grouped together with a double fold in the shape of an "S" and are superimposed by intercalation of the extremities so that it is possible manually to remove the bags from the central opening 9 of the cover 2 to present after each removal the extremity of the successive bags.

3 Claims, 1 Drawing Sheet

PLASTIC BOX CONTAINING BAGS MADE OF POLYETHYLENE FOR HYGIENIC USE GROUPED TOGETHER WITH A DOUBLE FOLD

The present invention relates to boxes made of plastic material and more specifically to boxes of rectangular shape to be placed on a wall. More specifically the present invention relates to a box which contains a box-like assembly of small bags made of polyethylene for hygienic use grouped together with a double fold in the shape of an "S" which may be removed one at a time from a front opening.

The main feature of the present invention is the fact that the external box consists of a bottom which may be applied to a wall and a cover which may be applied onto the bottom with a snap. The cover carries in the central position an opening from which the hygienic bags may be removed, the bags being contained in the assembly inserted in the interior of the box. In this manner it is possible to substitute the assembly of the bags after it has been exhausted with a new assembly utilizing always the same box affixed onto the wall as the container.

Another feature of the present invention resides in the particular manner according to which the bags are grouped in the interior of the box-like assembly made of cardboard to be inserted in the interior of the container. The double fold in the shape of an "S" permits in fact to remove from the central opening the bags one at a time without disturbing the bag and always presenting the border of the next bag to the exterior of the opening.

Figure 1:
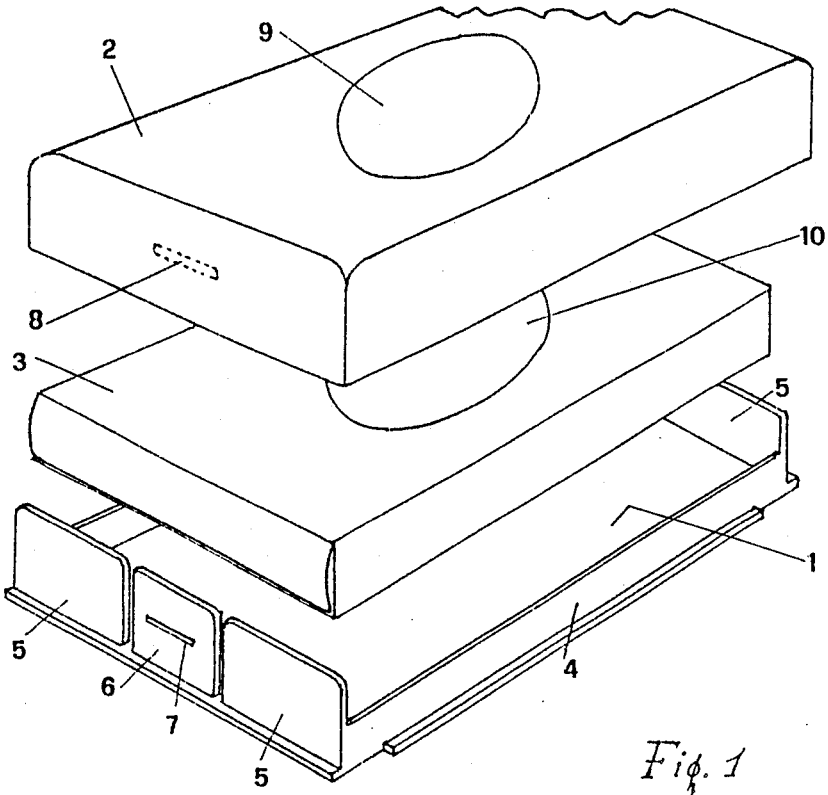
FIG. 1 is a perspective view of the different parts which compose the box of the present invention.
Figure 2:
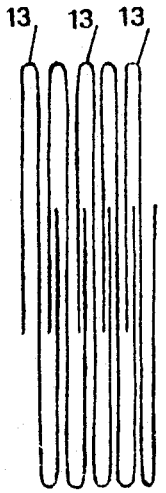
FIG. 2 shows the system of folding and grouping of the bags.
Figure 3:
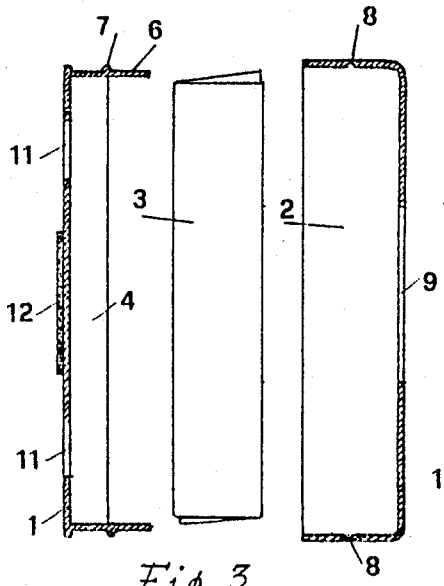
FIG. 3 is a side view partly in cross-section of the three components of the box separate one from the other.

As shown in FIGS. 1, 2 and 3, the box according to the present invention is composed of three main parts, the bottom 1 which has the shape of a rectangular basin which is intended to be fixed onto a wall, cover 2 which is snap insertable onto the bottom 1 and the box-like assembly 3 made of cardboard which contains the package of hygienic bags made of polyethylene.

FIGS. 1, 2 and 3 also show that the rectangular bottom 1 has the lateral borders 4 longer but smaller in height with respect to the shorter borders 5. In the latter there is formed a central border 6 which border due to the elasticity of the plastic material and the presence of the small central rib 7 is capable of holding the cover 2 when the same rib is pressure-fixed in the interior cut 8 of the cover.

Cover 2 has the upper corners rounded and has in the central position opening 9 to remove the small bags of the box-like assembly 3, which assembly has been previously inserted in the interior of the bottom 1 and which is provided with central opening 10 as shown in FIG. 1. After the three components of the box are superimposed as shown in FIG. 1, the central opening 10 corresponds to the opening 9 of the cover. In this manner the substitution of the assembly of bags after it has been exhausted with a new assembly is very easy because one may utilize again indefinitely the same main box which has been fixed on the wall.

Figure 4:
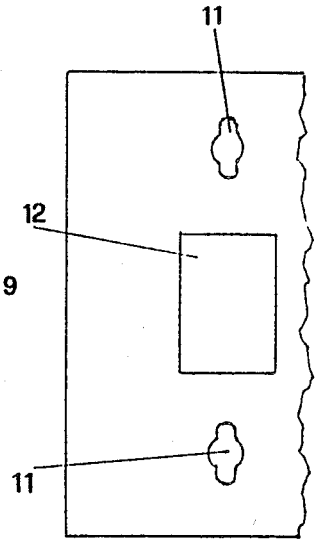
FIG. 4 shows the bottom of the box to be fixed on the wall.

The bottom 1 of the box may be fixed onto the wall by means of screws utilizing openings 11 shown in FIGS. 3 and 4 or may also be applied to the walls by pressure on a self-adhesive member 12 against the smooth surface of the wall.

FIG. 2 shows the bags 13 folded and grouped together in the interior of the box-like assembly 3 made of cardboard. The folding in the "S" shape with intercalated superimposition of the extremeties of the adjacent bags allows to carry out the removal of one bag from the superimposed openings 9 and 10 of the box and the assembly respectively, does not disturb at all the assembly of the bags and causes only the partial removal of the extremity of the successive bag so that the removal of the bags is very easy.

The foregoing shows that the advantages and the novelty of the present invention are clear, particularly if one considers the ease of substitution of the assemblies of the bags, the low cost of the article, which does not require the replacement of the entire box and the convenience of removal of the bags which are removed only one at a time.

What is claimed is:

1. A box made of plastic material which contains an assembly of bags made of polyethylene for hygienic use which comprises bottom (1) in the shape of a rectangular basin to be fixed onto a wall, cover (2) having rounded corners and a central opening (9), said cover being snap applied onto said bottom, and a box-like assembly of cardboard (3) insertable in the interior of the box and easily replaceable, said assembly containing a plurality of bags made of polyethylene for hygienic use, said bags being grouped together with a double fold, wherein said double fold is "S" shaped with intercalated superimposition of the extremities of said bags (13), said bags constituting the replaceable assembly whereby it is manually possible to remove said bags (13) through said central opening (9) of the cover one at a time without disturbing the assembly of bags (13), each of said bags presenting the border of the successive bag (13) in front of said opening (9) after each extraction.

2. The box according to claim 1 wherein said bottom has two long borders and two short borders, the height of the short borders being greater than the height of the long borders.

3. The box according to claim 2 wherein one of said short borders has a rib (7), said cover has a slit (8) and said rib is pressure fixed in said slit when the box is assembled.

* * * * *